United States Patent [19]

Iwai et al.

[11] 4,443,575

[45] Apr. 17, 1984

[54] COMPOSITION FOR BACKING CARPETS

[75] Inventors: Sakuya Iwai, Tokyo; Teruo Kajikawa, Yokosuka, both of Japan

[73] Assignee: Nippon Oil Co., Ltd., Nishishimbashi, Japan

[21] Appl. No.: 436,826

[22] Filed: Oct. 26, 1982

[30] Foreign Application Priority Data

Oct. 26, 1981 [JP] Japan ..... 56-171211

[51] Int. Cl.[3] ..... C08K 5/01

[52] U.S. Cl. ..... 524/486; 524/423; 524/563; 428/95; 428/96; 428/97

[58] Field of Search ..... 428/95, 96, 97; 524/485, 486, 562, 563, 423

[56] References Cited

U.S. PATENT DOCUMENTS 4,145,338 3/1979 Matsubara et al. ..... 524/486

4,243,568 1/1981 Brown ..... 524/562

*Primary Examiner*—Joseph L. Schofer

*Assistant Examiner*—J. Reddick

*Attorney, Agent, or Firm*—Ostrolenk, Faber, Gerb & Soffen

[57] ABSTRACT

A composition for backing a carpet, which contains (a) 5 to 65% by weight of an olefin-polar monomer copolymer having a polar monomer content of 5 to 40% by weight, (b) 1 to 50% by weight of a synthetic oil comprising one or more non-condensed tricyclic aromatic hydrocarbon compounds having a boiling point of 250° C. or higher and a molecular weight of 258 to 482, and being liquid at room temperature, (c) 30 to 90% by weight of an inorganic filler, and, if necessary, up to 50% by weight of a solid low-molecular compound component. The composition is particularly useful for automobile carpets and carpet tiles. The composition provides flexibility during blending, a high flexibility, and, in particular, a superior performance at low temperatures.

15 Claims, No Drawings

COMPOSITION FOR BACKING CARPETS

BACKGROUND OF THE INVENTION

1. Field of the Invention

The present invention relates to a composition for backing carpets in which an inorganic filler is blended in high concentrations. More particularly, the present invention relates to a carpet-backing composition having improved processability during heat blending, a high degree of flexibility, and, a particularly good performance at low temperatures, said composition being prepared by adding a synthetic oil having a particular structure when the inorganic filler is blended in high concentrations with an olefin-polar monomer copolymer.

The present invention further relates to a carpet for an automobile and to so-called carpet tiles in which said composition is backed onto a carpet in a molten form.

Carpets for automobiles are interior materials to be used for internal trim or decoration, and for providing effective heat insulation, soundproofing against engine noise or the like, and internal sound absorption. Backing materials for automobile carpets are required to perform the basic functions of reinforcing the carpet, imparting shape retaining properties thereto, preventing pile shedding, preventing shrinkage, and so on. A demand for improvement in comfort inside the car by reducing external noise such as engine noise has also been made. In order to meet this demand, backing materials having good soundproofing performance are required. Soundproofing performance is proportional to the mass per unit area of the backing material, so that the backing material is required to have a high density and some degree of thickness. Accordingly, it is desirable that a backing material having soundproofing properties in addition to performing other carpet functions is produced from low cost materials.

Carpet tiles are pieces of carpet in the shape of a square, rectangle, rhombus or the like or of a more complex shape, having an area of, for example, 0.05 to 2 $m^2$. The carpet tiles can be fitted next to each other to closely cover the floor. Carpet tiles have an advantage over ordinary carpets in that laying is easily performed merely by placing the carpet tiles side by side and fixing them. Carpet tiles also have the merit that they can provide a variety of visual impressions by using different combinations of shape and color, and the repair thereof is easy. In instances where the carpet tiles are laid on the floor, it is required that they adhere sufficiently to the floor so that no portion thereof is disturbed during use. Methods of adhering the carpet tiles to the floor include those in which an adhesive or a self-adhesive is employed or in which each tile is fastened with nails or rivets; however, these methods have the drawbacks that both laying and relaying are laborious and time-consuming. As a means of avoiding such labor-intensive laying, carpet tiles are known which may be fixed by their own weight, such carpet tiles being designed to have a sufficient weight for self-fixing by comprising a relatively thick backing material.

Backing materials for carpet tiles are also required to provide fiber-shedding prevention, dimensional stability, elasticity and various other properties to the carpet tiles. Backing materials for carpet tiles should, as a matter of course, provide those properties required of backing materials for general carpets together with further fixability to such a degree that the carpet tiles may be fixed merely by being laid on the floor. Further, this fixability should be provided without using expensive raw materials.

2. Description of the Prior Art

Backing materials for carpets are known of the rubber latex type, the elastomer type, the synthetic resin type and the asphalt type. They are disclosed in, for example, Japanese Patent Publication Nos. 3,839/1971, 20,199/1973, 34,556/1973, 17,851/1977 and 4,525/1978.

However, in instances where these known backing materials are employed on a carpet base material, their performance with respect to prevention of fiber shedding is so poor that original pile yarns of the carpet are likely to be frayed. These known backing materials have the additional disadvantages that they cannot be produced to a sufficient thickness and that their dyes are likely to ooze out onto the carpet surface. They also provide insufficient dimensional stability and fixability when used for carpet tiles. They further lack in reinforcement, shape retaining performance and soundproofing performance when used for automobile carpets.

Compositions are also known in which an olefin-polar monomer copolymer, for example, ethylene-vinyl acetate copolymer (EVA), is blended with an inorganic filler. As the amount of the inorganic filler increases, the preparation of homogeneously blended compositions becomes difficult. Even if a homogeneously blended composition can be obtained, it is brittle through an increase in hardness and is also inferior in tensile properties and low-temperature performance. Such a homogeneously blended composition also has various drawbacks in that its softening temperature and flowing temperature are much raised, thereby degrading processability and consequently rendering the conditions for processing it into carpet backing severe. Such a composition is accordingly inappropriate as a carpet-backing material.

In order to improve these drawbacks, attempts have been made to use a modifier a low-molecular compound such as paraffin wax, microcrystalline wax, rosin, rosin derivatives, petroleum resin, asphalt, polyethylene wax, amorphous polyethylene, mineral oil, animal or vegetable oil, polybutene, paraffin oil, or the like. As a result, processability during blending, physical properties and processability into backing material have all been improved to some extent, thereby producing modifying effects to allow use in certain applications. Such a modifier, however, is not satisfactorily compatible so that most of it becomes separated. As the addition of such an above-mentioned modifier may cause aging and cannot sufficiently improve tensile strength, low-temperature performance or flexiblity, such a composition is incapable of being practically applied to a carpet as a backing material therefor.

SUMMARY OF THE INVENTION

A primary object of the present invention is to provide a backing material which meets the requirements for a backing material for a carpet and can improve on the defects present in the above-mentioned conventional materials. The present invention has particularly for its object to provide a backing material suitable for automobile carpets and carpet tiles.

DETAILED DESCRIPTION OF THE PREFERRED EMBODIMENT

In order to provide a blended composition which does not deteriorate over time, is not subject to separation, has good tensile strength, flexibility and low-temperature performance, and offers improved blendability and backing processability as a composition for backing a carpet by blending an inorganic filler with an olefin-polar monomer copolymer in high concentrations, extensive studies have been made on a third component. As a result, it has been found that a synthetic oil, comprising one member or a mixture of two or more members selected from the group of non-condensed tricyclic aromatic hydrocarbon compounds which are liquid at room temperature, can provide a preferable result.

In accordance with the present invention. the carpet-backing material may comprise:

(a) 5 to 65% by weight of an olefin-polar monomer copolymer having a polar monomer content of 5 to 40% by weight therein;

(b) 1 to 50% by weight of a synthetic oil consisting of one or more members selected from the group of non-condensed tricyclic aromatic hydrocarbon compounds which have a boiling point of 250° C. or higher and a molecular weight of 258 to 482, and which are liquid at room temperature;

(c) 30 to 90% by weight of an inorganic filler; and (d) up to 50% by weight of a solid, low-molecular compound component.

The present invention also provides a carpet backed with the above backing material.

Further, the carpet-backing composition in accordance with the present invention may comprise:

(a) an olefin-polar monomer copolymer in an amount of 5 to 65% by weight, preferably 10 to 60% by weight, and more preferably 10 to 40% by weight, having a polar monomer content of 5 to 40% by weight therein;

(b) a synthetic oil in an amount of 1 to 50% by weight, preferably 2 to 35% by weight, and more preferably 2 to 20% by weight;

(c) an inorganic filler in an amount of 30 to 90% by weight, preferably 40 to 85% by weight, and more preferably 60 to 85% by weight; and, if necessary, (d) a solid, low-molecular compound component in an amount up to 50% by weight, preferably up to 20% by weight.

The olefin-polar monomer copolymer to be used in accordance with the present invention is such that the olefin component may be derived from a $C_2$ to $C_4$ olefin such as, and preferably, ethylene, and the polar monomer component may be derived either from a monomer which is copolymerizable with said olefin component, such as vinyl acetate, methyl acrylate, ethyl acrylate, acrylic acid, methyl methacrylate, ethyl methacrylate, methacrylic acid, carbon monoxide or from a mixture of two or more of these monomers. Preferred examples of the copolymer may include, for example, ethylene-vinyl acetate copolymer, ethylene-methyl acrylate copolymer, ethylene-ethyl acrylate copolymer, ethylene-ethyl acrylate-acrylic acid copolymer, ethylene-ethyl acrylate-vinyl acetate copolymer and so on. Among these copolymers, the ethylene-vinyl acetate copolymer (EVA) is particularly preferred.

The copolymers have a polar monomer content in an amount ranging from 5 to 40% by weight, and preferably from 10 to 35% by weight. It is undesirable that the polar monomer content exceed the upper limit, since the hardness of the resultant composition is decreased, thereby decreasing the tensile strength thereof and rendering a heat resistance thereof poor. It is also undesirable that the polar monomer content be below the lower limit, since the hardness of the resultant composition is increased, so that it becomes brittle with poor flexibility and reduced elongation, and since the brittle temperature of the low-temperature performance is rendered high. Further, the compatibility thereof with the synthetic oil which is the third component is decreased, whereby the tendency arises for the synthetic oil to separate.

The melt index of these copolymers may range from 0.1 to 400, preferably from 0.1 to 150, and more preferably from 0.2 to 50. It is undesirable that the melt index exceed the upper limit, since properties such as heat resistance, tensile strength and brittle temperature are thereby rendered poor. It is undesirable that the melt index be below the lower limit, since blendability and processability are thereby degraded.

The amount of the copolymer to be blended may range from 5 to 65% by weight, preferably from 10 to 60% by weight, and more preferably from 10 to 40% by weight. It is undesirable that the amount of the copolymer be below the lower limit, since the strength of the composition cannot thereby be maintained. It is not necessary that the amount of the copolymer exceed the upper limit in order to provide a composition having a desired high concentration of the inorganic filler, and it is preferable that the amount of the copolymer be restricted to the range mentioned hereinabove.

The synthetic oil (b) may be a non-condensed tricyclic aromatic hydrocarbon compound having a boiling point of 250° C. or higher and a molecular weight ranging from 258 to 482, and being liquid at room temperature, or may be a mixture of two or more such hydrocarbon compounds.

The non-condensed tricyclic aromatic hydrocarbon compound may include, for example, a compound containing three benzene rings or alkylbenzene rings and containing no condensed aromatic hydrocarbon nucleus, such as naphthalene, anthracene, phenanthrene or the like. Such a compound has a compatibility with the olefin-polar monomer copolymer (a) superior to that of an aliphatic hydrocarbon compound and a condensed aromatic hydrocarbon, and has a favorable effect in improving a dispersibility of the inorganic filler (c). Compounds having a boiling point below 250° C. and a molecular weight below 258 soften the resulting composition, decrease a heat resistance thereof and allow the synthetic oil to be easily separated and scattered. If compounds have a molecular weight over 482, they can hardly retain their liquid form at room temperature, and their compatibility with the olefin-polar monomer copolymer (a) is decreased.

Preferred compounds for the synthetic oil (b) are compounds which are liquid at room temperature and may be represented by the following formulas (I) and (II):

$$\begin{array}{c} Ar_3-R-Ar_1 \\ | \\ Ar_2 \end{array} \qquad \text{(I)}$$

$$Ar_1-R_1-Ar_2-R_2-Ar_3 \qquad \text{(II)}$$

where R is an alkane residue having from 4 to 6 carbon atoms, $R_1$ and $R_2$ are each an independent alkane residue having from 1 to 3 carbon atoms, and $Ar_1$, $Ar_2$, and $Ar_3$ are each an independent aryl group such that side alkyl groups on the aryl groups have 0 to 3 carbon atoms in total.

Examples of compounds included by formula (I) may be represented as follows:

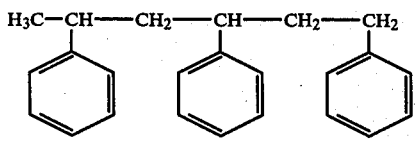

(1)

The alkyl derivatives may be represented as follows:

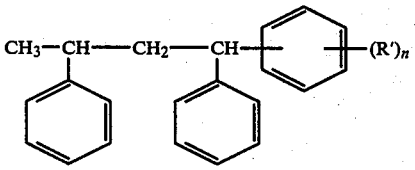

(2)

where n is an integer from 0 to 3, and R′ is a hydrogen atom or an alkyl group having from 1 to 3 carbon atoms which may be identical with or different from each other.

Most preferred compounds represented by formula (2) may be represented by formulas (3) and (4):

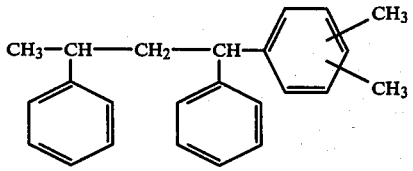

(3)

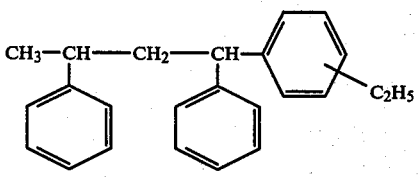

(4)

Other examples of compounds included by formula (I) may be a compound represented by formula (5) and a derivative thereof having an alkyl side chain or chains:

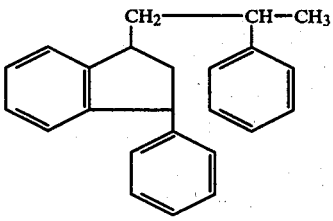

(5)

Examples of compounds included by formula (II) may be represented by formula (6):

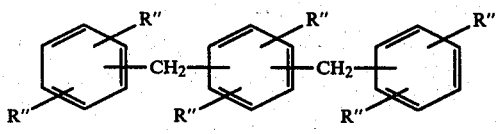

(6)

where each R″ may be identical with or different from others and is a hydrogen atom or an alkyl group having from 1 to 3 carbon atoms.

Examples of compounds represented by formula (6) may be compounds represented by formulas (7) and (8):

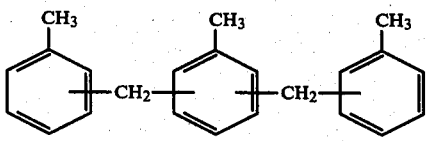

(7)

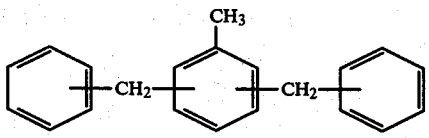

(8)

Other examples of compounds included by formula (II) may be represented by formula (9):

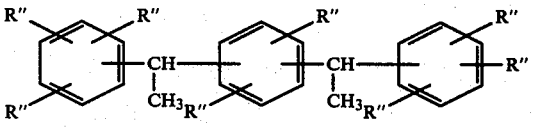

(9)

where each R″ may be identical with or different from others and is a hydrogen atom or an alkyl group having from 1 to 3 carbon atoms.

Examples of compounds represented by formula (9) may be represented by formulas (10) to (16), inclusive:

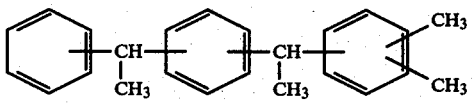

(10)

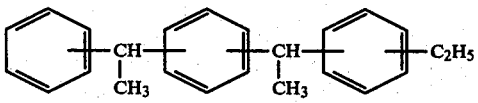

(11)

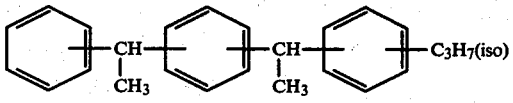

(12)

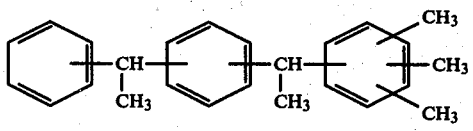

(13)

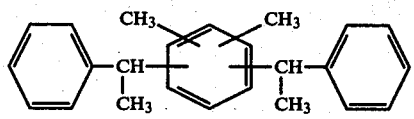

(14)

-continued

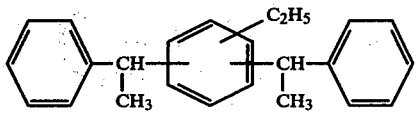

(15)

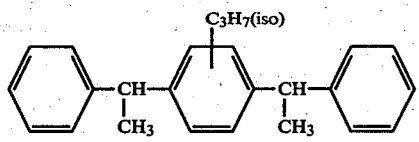

(16)

Other examples of compounds included by formula (II) may be represented by formula (17):

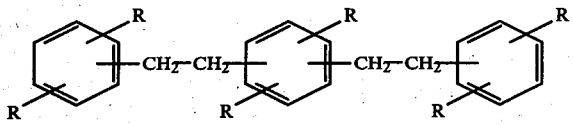

(17)

where each R may be identical with or different from others and is a hydrogen atom or an alkyl group having from 1 to 3 carbon atoms.

Examples of compounds represented by formula (17) may be compounds represented by formulas (18) to (21):

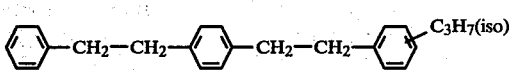

(18)

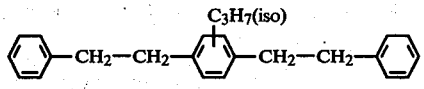

(19)

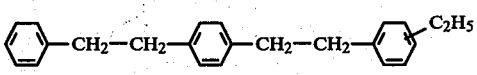

(20)

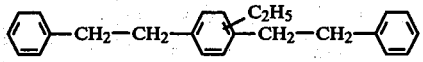

(21)

Further examples of compounds included by formula (II) may be a compound represented by formula (22) and its derivative represented by formula (23) and having an alkyl side chain on the aryl group:

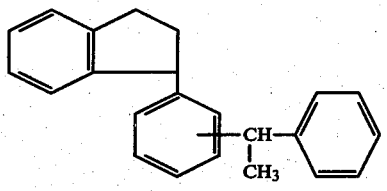

(22)

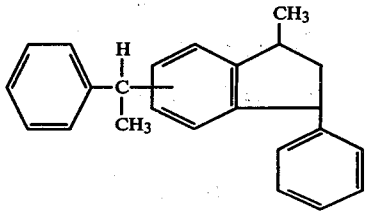

(23)

The compounds described hereinabove may each be preferably employed.

The compounds represented by formulas (1), (5), (22), and (23) are trimers of styrenes and may be readily prepared by allowing styrenes to react in the presence of an acidic catalyst such as sulfuric acid, HF, silica alumina or a cation exchange resin; or by subjecting them to heat reaction in either the presence or absence of a radical initiator. The compounds represented by formula (1) correspond to compounds obtainable by the hydrogenation of an unsaturated chain trimer of styrene. The alkyl derivatives of these compounds may also be easily obtained by alkylating these compounds or by using the corresponding alkylstyrenes in place of styrene or in combination therewith as a reaction material.

The compounds represented by formulas (2), (3), (4), and (9) to (16) may be readily obtained by reacting styrene or an alkylstyrene with benzene or with an alkylbenzene having side chains with up to 3 carbon atoms in total in the presence of an acidic catalyst such as sulfuric acid, HF, silica alumina, a cation exchange resin or the like. The reaction may also produce the compounds represented by formulas (1), (5), (22) and (23) simultaneously. Those compounds may also be readily obtained by condensing the corresponding chloride with benzene or with the corresponding alkylbenzene in the presence of a Friedel-Crafts catalyst such as aluminum chloride or the like with dehydrochlorination effected at the same time, or by condensing benzene or the corresponding alkylbenzene with acetoaldehyde in the presence of a condensing agent such as sulfuric acid. Furthermore, an economic method exists which involves separation and recovery from by-product heavy oil obtained in preparing ethylbenzene from benzene and ethylene in the presence of a Friedel-Crafts catalyst such as aluminum chloride.

The compounds represented by formulas (6), (7) and (8) may be prepared by condensing benzene or the corresponding alkylbenzene with formaldehyde or paraformaldehyde in the presence of sulfuric acid or other suitable condensing agents, or by reacting the corresponding aryl chloride with benzene or with the corresponding alkylbenzene in the presence of a Friedel-Crafts catalyst such as aluminum chloride or the like.

The compounds represented by formulas (17) to (21) may be obtained by reacting benzene or the corresponding alkylbenzene with 1,2-dichloroethane in the presence of a Friedel-Crafts catalyst such as aluminum chloride or the like. Furthermore, the resulting reaction products may be alkylated.

In the processes described hereinabove, it is economically desirable to use a mixture of compounds as the synthetic oil when the synthetic oil is obtained as a mixture of two or more compounds. The use of the mixture as the synthetic oil can provide the preferred effects on performance.

The amount of the synthetic oil may range from 1 to 50% by weight, preferably from 2 to 35% by weight, and more preferably from 2 to 20% by weight. It is undesirable that the amount exceed the upper limit, since such a large amount of the synthetic oil not only causes softening of the resultant composition and lowers a heat resistance and a tensile strength thereof, but also causes the synthetic oil to separate from the resulting composition. Where the amount of the synthetic oil is below the lower limit, no effect can be obtained by using the synthetic oil.

Although the synthetic oil (b) in accordance with the present invention has a favorable compatability with the above-enumerated olefin-polar monomer copolymers, the compatibility is rendered more favorable by an increase in the polar monomer content of the copolymer. The synthetic oil does not separate under any conditions within the above-defined range of the polar monomer content, thereby imparting flexibility to the resultant composition and, in particular, acting effectively to lower its brittle temperature. In accordance with the present invention, use of the synthetic oil can reduce the difficulty of processing the composition and furthermore can lower the softening temperature of the composition by an appropriate amount, whereby processability as a carpet-backing material can be improved.

The inorganic filler (c) to be used in the present invention may be a filler which has been employed for rubber and plastics. The filler is described, for example, in chapters 11 and 12 of "Handbook of Chemicals for Use with Rubbers and Plastics" (Rubber Digests K.K.; issued in 1974). More specifically, the inorganic filler may include, for example, calcium carbonates, clay, silica, alumina, talc, barium sulfate, calcium sulfate, calcium sulfite, zinc white, carbon black, aluminum hydroxide, magnesium hydroxide or the like. The amount of the inorganic filler may range from 30 to 90% by weight, preferably form 40 to 85% by weight, and more preferably from 60 to 85% by weight. Where the amount of the inorganic filler is above the upper limit, the resulting composition becomes too hard and too brittle for practical use. Where the amount of the inorganic filler is below the lower limit, the object of the present invention cannot be accomplished. Thus, the amount thereof is preferably within the above-defined range.

A solid low-molecular compound component (d) may also be blended if necessary. The solid low-molecular compound component may include, for example, asphalt, rosin, rosin derivatives, petroleum resin, paraffin wax, microcrystalline wax, amorphous polypropylene, polyethylene wax or the like. The component may comprise only one or an admixture containing two or more of the above materials. The solid low-molecular compound component may be used in amounts up to 50% by weight, preferably up to 35% by weight, and more preferably up to 20% by weight. It is undesirable that the amount of the component exceed the upper limit, since, in particular, the brittle temperature is greatly raised.

If necessary, an antioxidant, an antistatic agent, a coloring agent or the like may also be added in amounts of 0.01 to 5.0% by weight.

The composition in accordance with the present invention may be blended with a mixer such as a kneader, Brabender, Banbury mixer or the like. The blending with the mixer may be conducted by adding thereto each necessary amount of (a) the olefin-polar monomer copolymer, (b) the synthetic oil, (c) the inorganic filler, and, if necessary, (d) the solid low-molecular compound component. The order of adding the components to the mixer is not restricted. The heating temperature may range from 100° to 200° C. and preferably from 110° to 180° C., and a period of time required for the blending may range from 5 to 40 minutes and preferably from 8 to 30 minutes, whereby a sufficiently homogeneous mixture can be obtained. The resultant composition is then extruded at 100° to 220° C. with an extruder and formed into powders, pellets, film, sheets or the like. The composition may be extruded immediately after blending in the form of a film or a sheet directly onto the carpet base material thereby being processed directly to back the carpet base material. The composition prepared in the form of powders may be backed by scattering the composition uniformly on the rear surface of a carpet base material and then fusing it by heating. The composition in the form of pellets may be backed by first extruding the pellets with an extruder or the like into a sheet or a film, so that it may then be backed by laminating the sheet or the film onto the carpet base material with an adhesive or by heating. The carpet base material thus backed may be laminated, if necessary, with fabric, non-woven fabric, plastic film, paper, felt or the like.

The carpet base material on which or for which the composition in accordance with the present invention may be used may include, for example, woven carpet, knitted carpet, tufted carpet, needle punch carpet, artificial turf or the like. The tufted carpet is particularly preferred. These carpet base materials may be pretreated by, for example, the latex-type precoat treatment, the precoat treatment with an EVA hot melt type adhesive, the precoat treatment with a low-density polyethylene film or the like.

The present invention will be described in more detail by way of examples and comparative examples.

EXAMPLES 1 TO 8

The carpet-backing compositions having high concentrations of inorganic fillers as shown in Table 1 were prepared by blending predetermined amounts of the inorganic filler, the olefin-polar monomer copolymer, the synthetic oil, and asphalt at a heating temperature of 140° C. for 10 minutes with a kneader of the electrical heating type. Raw materials used for the blending were as follows:

Olefin-polar monomer copolymers:

EVA #1: Ethylene-vinyl acetate copolymer (vinyl acetate content, 19% by weight; melt index, 2.5)

EVA #2: Ethylene-vinyl acetate content, 25% by weight; melt index, 2.0)

EVA #3: Ethylene-vinyl acetate copolymer (vinyl acetate content, 28% by weight; melt index, 8.0)

EEA: Ethylene-ethyl acrylate copolmer (ethyl acrylate content, 26% by weight; melt index, 3.0)

Synthetic oil:

Synthetic oil A: Prepared by fully distilling a fraction obtained by the reation of ortho-oxylene with styrene in the presence of sulfuric acid as a catalyst. Contains compounds of formulas (3), (10) and (14) as major components and further compounds of formulas (1), (22) and (23).

Synthetic oil B: Prepared by the same procedures as Synthetic oil A by reacting a $C_9$ aromatic hydrocarbon fraction (containing trimethylbenzene and cumene as major components) with styrene. Contains compounds of formulas (12), (13) and (16).

Synthetic oil C: Prepared by reacting a $C_8$ aromatic hydrocarbon fraction (ortho-xylene, 32.8%; meta-xylene, 37.6%; para-xylene, 19.6%; ethylbenzene, 10.0%) with styrene in the presence of synthetic silica alumina as a catalyst. Contains a mixture of compounds of formulas (1), (3) to (5), (10), (11), (14), (15), (22) and (23).

Synthetic oil D: Prepared by vacuum distillation of a reaction product obtainable by reacting a mixture of equimolar amounts of benzene and cumene with 1,2-dichloroethane in the presence of an aluminum chloride catalyst. Contains a mixture of compounds of formulas (18) and (19) as examples of a compound of formula (17) as a major component. Synthetic oil E: Prepared by reacting toluene with chloromethyltoluene by heating under reflux. A compound of formula (7).

Inorganic filler: Heavy calcium carbonate

Solid low-molecular compound: Asphalt: 80 to 100 straight asphalt; softening point, 47° C. (Nippon Sekiyu K.K)

In each example, the components were blended well so as to produce a homogeneous composition within 1 to 2 minutes after the initiation of blending.

In each example, physical properties were evaluated by the following test procedures:

Density: JIS K 6760 (Alcohol-substitution method)

Softening point: JIS K 2207 (Ring and ball method)

Hardness: JIS K 6301 (Spring hardness tester A model)

Deformation under load: Using a 10-mm thick test specimen, the degree of deformation was observed by applying a load of 5 kg to a 1.0 $cm^2$ cylindrical pressure body for 5 minutes in an air atmosphere at 60° C., and was measured in units of 0.01 mm. The values given are measured values multiplied by 100.

Brittle temperature: JIS K 6301

Tensile strength and percent elongation: JIS K 6760

Tear strength: JIS K 6301 (B type)

Degree of bleed: Finger touch observation

The physical properties of the compositions obtained in Examples 1 to 8, inclusive, are shown in Table 1. Each composition has a density in excess of 1.5, a high degree of flexibility and a nil degree of bleed. Each also exhibits a low deformation under load at 60° C., and a sufficiently high heat resistance. The compositions obtained in the examples described below each have a brittle temperature below minus 10° C., which is the primary improvement object of the present invention, and exhibit a superior low-temperature performance. The tensile strength and the percent elongation of each compound satisfies the practical requirements. The respective softening temperatures are each below 190° C., thereby meeting the requirements for backing processability.

TABLE 1

| | | | Example No. | | | | | | | |
|---|---|---|---|---|---|---|---|---|---|---|
| | | | 1 | 2 | 3 | 4 | 5 | 6 | 7 | 8 |
| Ingredients (wt %) | Olefin-polar monomer copolymer | EVA or EEA | EVA #2 25 | EVA #2 20 | EVA #1 22 | EVA #2 20 | EVA #3 20 | EEA 24 | EVA #1 15 | EVA #2 20 |
| | Synthetic oil | A | 15 | 15 | — | — | — | — | — | — |
| | | B | — | — | 8 | 10 | — | — | — | — |
| | | C | — | — | — | — | 10 | 6 | — | — |
| | | D | — | — | — | — | — | — | 10 | — |
| | | E | — | — | — | — | — | — | — | 5 |
| | Inorganic filler | Calcium carbonate | 60 | 65 | 70 | 70 | 70 | 70 | 75 | 70 |
| | Low-molecular compound component | Asphalt | — | — | — | — | — | — | — | 5 |
| Physical properties | Density 20° C. (g/$cm^3$) | | 1.55 | 1.64 | 1.73 | 1.74 | 1.73 | 1.73 | 1.84 | 1.74 |
| | Softening point R&B (°C.) | | 130 | 130 | 168 | 168 | 137 | 190 | 162 | 175 |
| | Hardness 20°C. | | 80 | 85 | 93 | 90 | 84 | 94 | 92 | 93 |
| | Deformation 60° C. under load (1/100 mm) | | 16 | 15 | 4 | 11 | 19 | 6 | 13 | 8 |
| | Brittle temperature (°C.) | | −24 | −20 | −12 | −18 | −22 | −13 | −10 | −14 |
| | Tensile Strength (Kg/$cm^2$) | | 27 | 22 | 49 | 42 | 29 | 53 | 38 | 53 |
| | Percent elongation (%) | | 490 | 150 | 30 | 45 | 35 | 30 | 28 | 30 |
| | Tear strength (Kg/cm) | | 27 | 23 | 27 | 28 | 20 | 32 | 19 | 31 |
| | Degree of bleed | | None | None | None | None | None | None | None | None |

COMPARATIVE EXAMPLES 1 TO 7

As will be shown in Table 2 below, in comparative examples in which no synthetic oil is employed, the compositions were prepared in the same manner as in the Examples and were tested for the same physical properties as the compositions of the Examples.

COMPARATIVE EXAMPLE 1

In this comparative example, a two-component system of EVA and calcium carbonate was used, but the blendability with a kneader was poor compared with the other examples. The softening point of the resulting composition was so high that a problem in processing for a backing was caused, and the brittle temperature was unsatisfactory.

COMPARATIVE EXAMPLE 2

In this comparative example, a part of the EVA was substituted by microcrystalline wax (MC wax). This slightly improved processability during blending as compared with Comparative Example 1, but did not improve various material properties. This composition did not lower the brittle temperature as expected with no blended effect.

COMPARATIVE EXAMPLE 3

In this comparative example, a part of the EVA was substituted by the asphalt used in Example 8. This gave improved processability during blending and an improved softening temperature as compared with Comparative Example 1, but it did not lower the brittle temperature, and some bleed occurred at the surface of the composition, giving rise to little overall improvement.

COMPARATIVE EXAMPLE 4

In this comparative example, a part of the EVA was substituted by rosin. This generated the odor by decomposition of rosin during the blending. The brittle temperature of the composition was raised, although its softening temperature was lowered.

COMPARATIVE EXAMPLE 5

In this comparative example, a part of the EVA was substituted by coconut oil. This improved the softening and brittle temperatures to a great extent, but bleed occurred from the composition to a significant degree, thereby causing problems with practical application.

COMPARATIVE EXAMPLES 6 AND 7

In these comparative examples, a part of the EVA was substituted by machine oil and with process oil (Nisseki Comolex 700), respectively. The softening and brittle temperatures were improved to a great extent, and the tensile strength satisfied various requirements for carpet backing. The compositions, however, exhibited bleed, so that their practical application is not favorable.

TABLE 2

| | | | Comparative example No. | | | | | | |
|---|---|---|---|---|---|---|---|---|---|
| | | | 1 | 2 | 3 | 4 | 5 | 6 | 7 |
| Ingredients (wt %) | Olefin-polar monomer copolymer | EVA | EVA #2 30 | EVA #2 20 | EVA #2 20 | EVA #2 20 | EVA #2 20 | EVA #2 20 | EVA #2 20 |
| | Inorganic filler | Calcium carbonate | 70 | 70 | 70 | 70 | 70 | 70 | 7 |
| | Low-molecular compound component | — | — | MC wax 10 | Asphalt 10 | Rosin 10 | Coconut oil 10 | Machine oil 10 | Process oil 10 |
| Physical properties | Density 20° C. (g/cm$^3$) | | 1.72 | 1.70 | 1.75 | 1.76 | 1.72 | 1.70 | 1.73 |
| | Softening point R&B (°C.) | | <200 | <200 | 192 | 180 | 153 | 154 | 165 |
| | Hardness 20° C. | | 97 | 95 | 94 | 95 | 80 | 90 | 91 |
| | Deformation 60° C. under load (1/100 mm) | | 2 | 7 | 7 | 13 | 17 | 18 | 11 |
| | Brittle temperature (°C.) | | −5 | −2 | −3 | +5 | −20 | −20 | −12 |
| | Tensile strength (Kg/cm$^2$) | | 72 | 40 | 57 | 52 | 26 | 37 | 41 |
| | Percent elongation (%) | | 30 | 25 | 33 | 60 | 560 | 42 | 68 |
| | Tear strength (Kg/cm) | | 40 | 21 | 29 | 37 | 17 | 24 | 32 |
| | Degree of bleed | | None | None | Slight | Little | High | High | Slight |

What is claimed is:

1. A composition for backing a carpet, comprising:
(a) 5 to 65% by weight of an olefin-polar monomer copolymer having a polar monomer content of 5 to 40% by weight therein;
(b) 1 to 50% by weight of a synthetic oil comprising one or more non-condensed tricyclic aromatic hydrocarbon compounds having a boiling point of 250° C. or higher and a molecular weight of 258 to 482, and being liquid at room temperature;
(c) 30 to 90% by weight of an inorganic filler; and
(d) 0 to 5% by weight of a solid low-molecular compound component, said composition having been mixed at 100°–200° C.

2. A carpet-backing composition according to claim 1, wherein said non-condensed tricyclic aromatic hydrocarbon compound is a compound represented by general formula (I) or (II):

$$\begin{array}{c} Ar_1-R-Ar_3 \\ | \\ Ar_2 \end{array} \quad (I)$$

$$Ar_1-R_1-Ar_2-R_2-Ar_3 \quad (II)$$

where R is an alkane residue having from 4 to 6 carbon atoms, $R_1$ and $R_2$ are each an independent alkane residue having from 1 to 3 carbon atoms, and $Ar_1$, $Ar_2$ and $Ar_3$ are each an independent aryl group having a side chain or chains with carbon atoms of 0 to 3 in total.

3. A carpet-backing composition according to claim 1, wherein said olefin-polar monomer copolymer has the polar monomer content of 10 to 35% by weight.

4. A carpet-backing composition according to claim 1, 2 or 3, wherein the olefin-polar monomer copolymer (a) is in the amount ranging from 10 to 40% by weight; the non-condensed tricyclic aromatic hydrocarbon compound (b) is in the amount ranging from 2 to 20% by weight; and the inorganic filler (c) is in the amount ranging from 60 to 85% by weight.

5. A carpet-backed with a carpet-backing composition comprising:
(a) 5 to 65% by weight of an olefin-polar monomer copolymer having a polar monomer content of 5 to 40% by weight;
(b) 1 to 50% by weight of a synthetic oil comprising one or more non-condensed tricyclic aromatic hydrocarbon compounds having a boiling point of 250° C. or higher and a molecular weight of 258 to 482, and being liquid at room temperature;
(c) 30 to 90% by weight of an inorganic filler; and
(d) 0 to 50% by weight of a solid low-molecular compound component, said composition having been mixed at 100°–200° C.

6. A carpet according to claim 5, wherein said non-condensed tricyclic aromatic hydrocarbon compound is a compound represented by general formula (I) or (II):

$$\begin{array}{c} Ar_3-R-Ar_1 \\ | \\ Ar_2 \end{array} \quad (I)$$

-continued $$Ar_1—R_1—Ar_2—R_2—Ar_3 \quad (II)$$

wherein R is an alkane residue having from 4 to 6 carbon atoms, $R_1$ and $R_2$ are each an independent alkane residue having from 1 to 3 carbon atoms, and $Ar_1$, $Ar_2$ and $Ar_3$ are each an independent aryl group having 0 to 3 side chains in total.

7. A carpet according to claim 5, wherein said olefin-polar monomer copolymer has the polar monomer content of 10 to 35% by weight.

8. A carpet according to claim 5, wherein said olefin-polar monomer copolymer (a) is in the amount ranging from 10 to 40% by weight, said non-condensed tricyclic aromatic hydrocarbon compound (b) is in the amount ranging from 2 to 20% by weight, and said inorganic filler (c) is in the amount ranging from 60 to 85% by weight.

9. A carpet according to claim 5, 6, 7 or 8, wherein said carpet is a tufted carpet.

10. A carpet according to claim 5, 6, 7 or 8, wherein said carpet is a carpet for automobiles.

11. A carpet according to claim 5, 6, 7 or 8, wherein said carpet is a carpet tile.

12. A carpet-backing composition according to claim 1, wherein said olefin-polar monomer copolymer is 15 to 25% by weight, the synthetic oil is 5 to 15% by weight, the inorganic filler is 60 to 75% by weight and the solid low-molecular compound component is 0 to 5% by weight.

13. A carpet-backing composition according to claim 12, wherein said olefin-polar monomer copolymer is an ethylene vinyl acetate copolymer containing 19 to 28% by weight of vinyl acetate and having a melt index of 2–8 or an ethylene ethyl acrylate copolymer containing 26% ethyl acrylate having a melt index of 3, and wherein said synthetic oil comprises (a) a mixture of

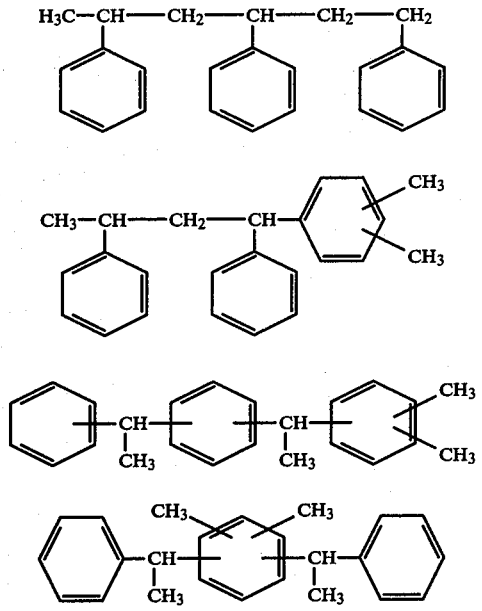

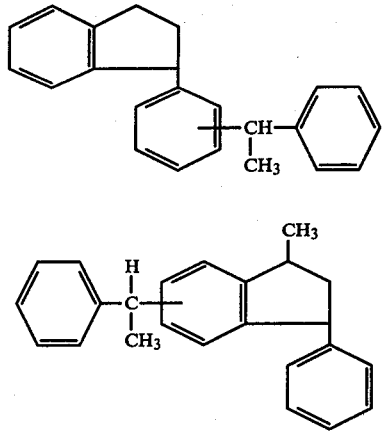

(b) a mixture of

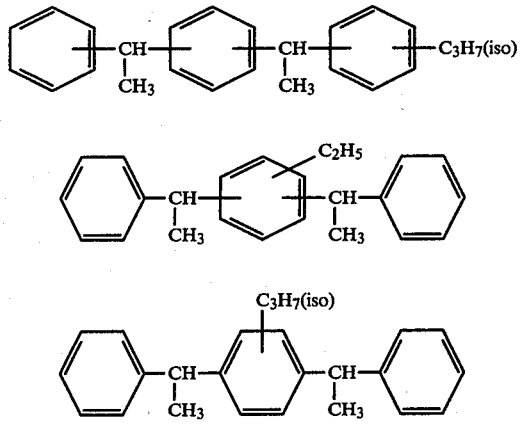

(c) a mixture of

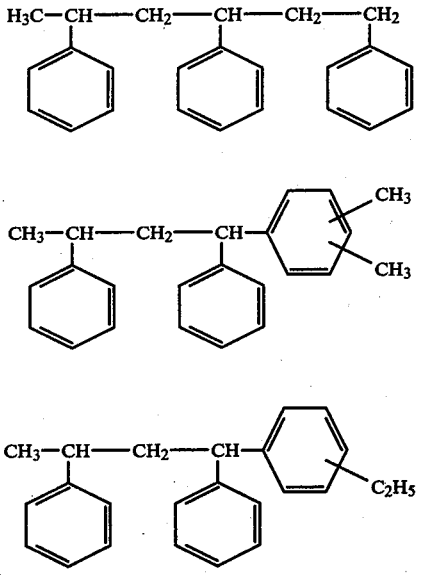

-continued

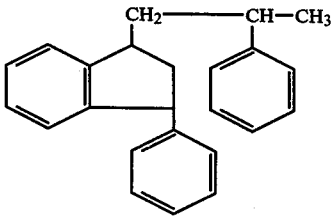

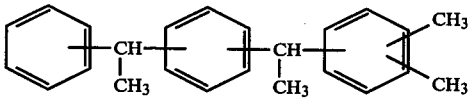

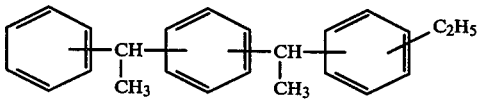

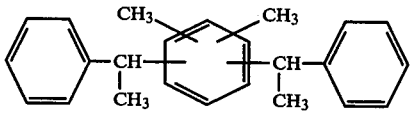

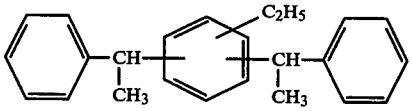

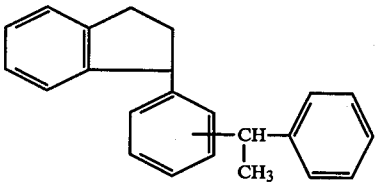

-continued

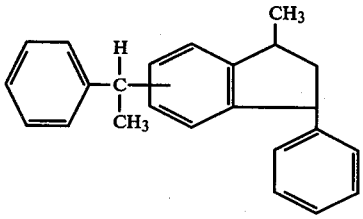

(d) a mixture of

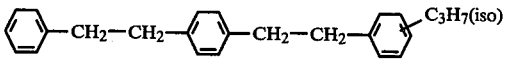

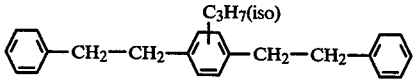

or (e)

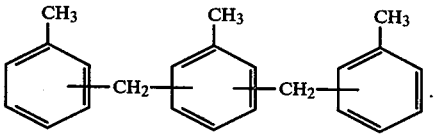

14. A carpet-backing composition according to claim 5, wherein said olefin-polar monomer copolymer is 15 to 25% by weight, the synthetic oil is 5 to 15% by weight, the inorganic filler is 60 to 75% by weight and the solid low-molecular compound component is 0 to 5% by weight.

15. A carpet-backing composition according to claim 13, wherein said olefin-polar monomer copolymer is 15 to 25% by weight, the synthetic oil is 5 to 15% by weight, the inorganic filler is 60 to 75% by weight and the solid low-molecular compound component is 0 to 5% by weight.

* * * * *